United States Patent [19]

Huempfner

[11] 4,186,456

[45] Feb. 5, 1980

[54] RAIL SYSTEM FOR BED OR STRETCHER

[75] Inventor: David F. Huempfner, Kewaunee, Wis.

[73] Assignee: American Hospital Supply Corporation, Evanston, Ill.

[21] Appl. No.: 924,777

[22] Filed: Jul. 14, 1978

[51] Int. Cl.[2] ..... A47C 7/00

[52] U.S. Cl. ..... 5/428; 5/430; 297/417

[58] Field of Search ..... 5/100, 331, 424–430; 297/416, 417; 248/226

[56] References Cited

U.S. PATENT DOCUMENTS

| | | | |
|---|---|---|---|
| 2,136,088 | 11/1938 | Stevens | 5/331 |
| 2,195,955 | 4/1940 | Hillenbrand | 248/226 |
| 2,786,214 | 3/1957 | Armstrong | 5/331 |
| 3,179,957 | 4/1965 | Norton | 5/331 |
| 3,221,350 | 12/1965 | Atkinson | 5/331 |
| 3,486,176 | 12/1969 | Murcott | 5/331 |
| 3,853,372 | 12/1974 | Meyer | 297/417 |
| 3,901,527 | 8/1975 | Danziger et al. | 297/417 |
| 3,971,083 | 7/1976 | Peterson | 5/331 |

*Primary Examiner*—Casmir A. Nunberg
*Attorney, Agent, or Firm*—Larry N. Barger

[57] ABSTRACT

A patient restraining rail system for a bed, stretcher, or the like which includes a rail pivotally connected to a vertically adjustable rail support.

14 Claims, 8 Drawing Figures

RAIL SYSTEM FOR BED OR STRETCHER

BACKGROUND

It is known to use a patient restraining rail system on a bed or stretcher. One type of railing system is described in U.S. Pat. Nos. 2,195,955; 2,136,088; and 2,786,214. These patents describe a rail which is pivoted below the mattress of the pad so it can laterally swing out from the bed and be positioned in a downward manner for entrance and exit of the patients from the bed. The pivot axis of such rail had to be very low so as not to interfere with a patient sitting on an edge of the bed, and the rail had to extend upwardly across the mattress thickness and sufficiently higher to form a restraint. These outwardly pivotal rails often more than doubled the bed width when they were swung out from opposite sides. Thus, it was difficult to pivot the rail when the bed was near a wall or adjacent an adjoining bed. If the rail system were on a stretcher, it had to be lowered while the stretcher was several feet from the bed in which a patient was to be transferred. In compact hospital rooms and corridors, the outwardly pivoting side rail required an acceptional amount of space for their swing.

Another type of patient restraining rails are the vertically sliding type, as shown in U.S. Pat. No. 3,179,957; 3,486,176; and 3,221,350. Although these required substantially less space for operation, they were more cumbersome to operate because the entire weight of the side rail must be lifted by the operator. In a pivoting side rail structure described above, half of the rail's weight was borne by the pivot joint. Also, a pivot joint is quicker and more easily moved than a sliding joint which may occasionally bind. This can be appreciated when comparing a sliding door to the ease and quickness of a conventional hinged pivot door.

Another U.S. Pat. No. 3,971,083 describes a side rail which pivots in a direction longitudinal to the bed. Such structure has a disadvantage in that any variable height adjustment also changes its longitudinal position on the bed. Sometimes for patient comfort, etc., it is desirable to raise and lower the bed rail without changing its horizontal position. Such might occur when an administration set, urinary drain tube, or other medical equipment is taped to the rail to position it relative to the patient.

SUMMARY OF THE INVENTION

The present invention overcomes the above problems by providing a bed rail that has a vertically adjustable support and a pivotal connection between the rail and support which permits the rail to swing outwardly in a lateral direction from the bed as it is lowered. This provides substantially improved mobility in altering the particular position of a patient restraining bed rail.

THE DRAWINGS

DETAILED DESCRIPTION

Figures 1, 2, 3, 4:
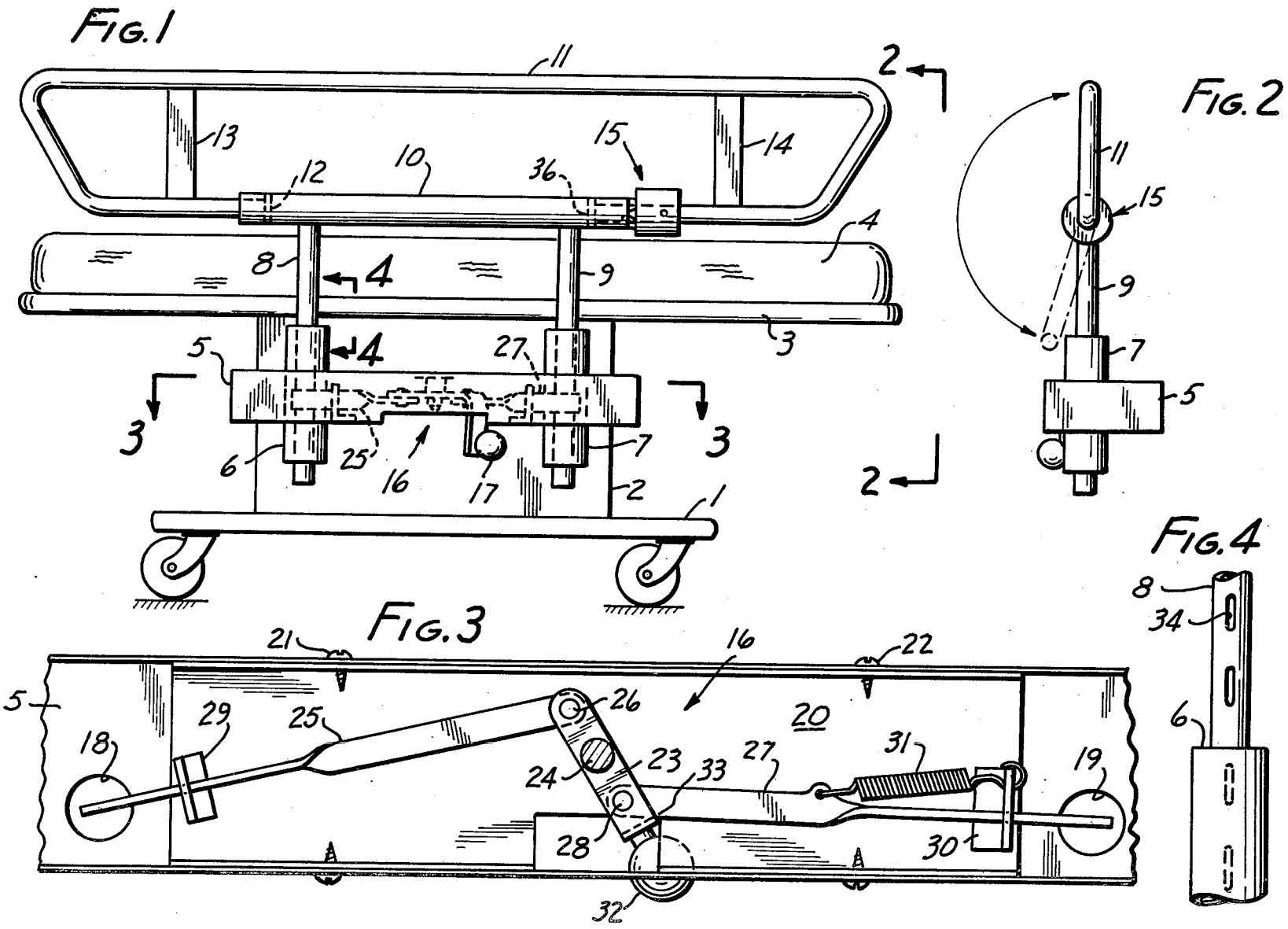
FIG. 1 is a side elevational view of a patient stretcher on which is mounted the restraining rail system.
FIG. 2 is a side elevational view of the rail system taken along line 2—2 of FIG. 1.
FIG. 3 is a sectional view taken along line 3—3 of FIG. 1.
FIG. 4 is a fragmentary view taken along line 4—4 of FIG. 1.

In FIG. 1, a stretcher is shown which includes a wheeled truck element 1, which can include a vertically adjustable structure 2 connected to a mattress support 3. Since the details of the wheeled truck and vertical adjustment mechanism form no part of this invention, they are shown only schematically. A mattress 4 rests on mattress support 3.

Mounted on wheeled truck 1 is a rail support base 5 which includes a pair of tubular guides 6 and 7. A pair of posts 8 and 9 are telescopically received in guides 6 and 7, and are connected at their top ends to a tubular transverse anchoring member 10. A generally C-shaped tubular rail 11 is positioned relative to anchoring member 10 so that the gap in the generally C-shaped rail is spanned by anchoring member 10. Thus, rail 11 can pivot with a swivel motion in an outward direction laterally away from the structure. Opposite ends of anchoring member 10 preferably include a tubular bushing for smooth swivel action and a stop pin, one of which is shown at 12, to prevent longitudinal shifting of rail 11 relative to anchoring member 10. It is understood that such bushing in pin can be at both ends of anchoring member 10. Also, for structural rigidity of rail 11, braces 13 and 14 can be used.

Figure 5:
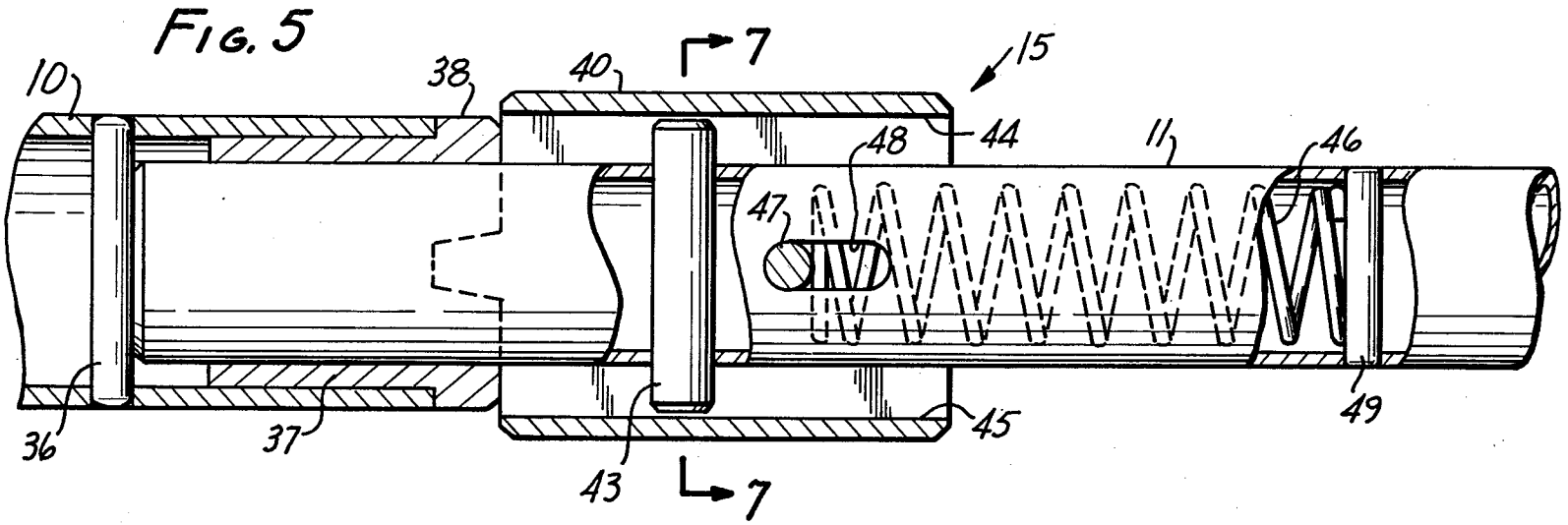
FIG. 5 is an enlarged sectional view of a lock structure between the rail and its support system showing it in locked position.
Figure 7:
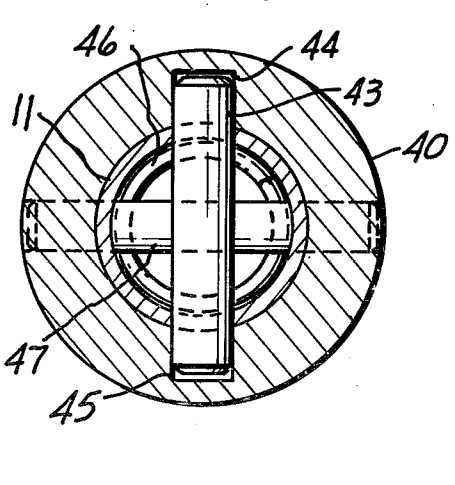
FIG. 7 is a sectional view taken along line 7—7 of FIG. 5.
Figure 6:
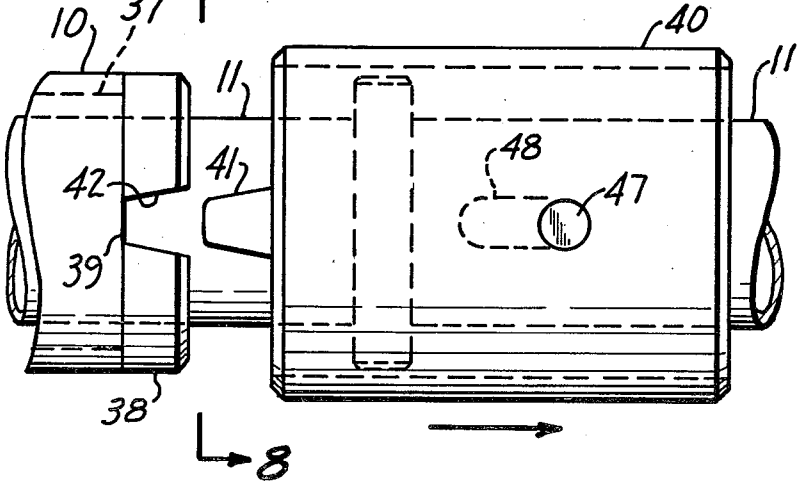
FIG. 6 is a fragmentary view of the lock of FIG. 5 showing it in unlocked position.
Figure 8:
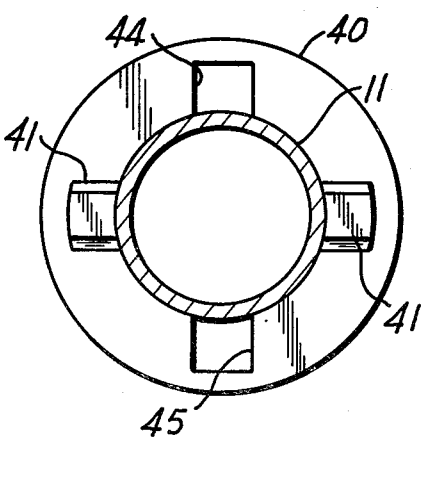
FIG. 8 is a sectional view taken along line 8—8 of FIG. 6.

Holding the rail 11 in its upright position as shown in FIG. 1 is a locking structure indicated generally at 15. Details of this locking structure are shown in FIGS. 5–7. As seen in FIGS. 1 and 2, the rail 11 can pivot outwardly away from the bed into a lowered position shown in dotted line in FIG. 2. In addition, the anchoring member 10, which lies along the pivot axis of rail 11, can be raised and lowered relative to a base 5 which is connected to the stretcher. The height of anchoring member 10 is controlled by a latch means 16, which includes handle 17 which engages both guides 6 and 7, as well as posts 8 and 9.

FIG. 3 shows the details of latch means 16 in which the base 5 is shown with apertures 18 and 19 into which fits the guides 6 and 7 respectively. Tubular posts 8 and 9 in turn fit inside guides 6 and 7. For clarity and illustration, neither the posts nor their tubular guides have been shown in FIG. 3. Fitting inside hollow base 5 is a generally U-shaped panel 20 secured to base 5 by screws, such as 21 and 22. A bar 23 is pivotally connected to panel 20 at 24. One end of bar 23 is pivotally connected to a prong member 25 by a pivot 26. A prong member 27 is pivotally connected to bar 23 at 28. Preferably, these prongs are in a horizontal position at their pivot connection to bar 23, but are twisted into a vertical section at their tips. The vertical sections extend through guides 29 and 30, and a spring 31 biases them toward a protruding position into apertures 18 and 19. A handle 17, which preferably has an outer end portion downwardly offset from the pivot 24, provides manual control for retracting prongs 25 and 27. Handle 17 can abut a portion 33 of the panel 20 which can act as a stop.

FIG. 4 shows the slotted openings 34 in post 8. When prong 25 is protruding, it can extend through a slot in guide 6, and one of a plurality of slots 34 in post 8. This secures the rail support in a particular height location. Movement of handle 17 retracts the prongs 25 and 27 so the posts 8 and 9 can be raised or lowered to a different height setting. Any number of slots 34 could be used on the posts 8 and 9, but it has been found that three slots work exceedingly well for a low, medium, and high position.

The locking member 15 shown in FIG. 1 is illustrated in more detail in FIG. 5. Here the generally C-shaped rail 11 is telescoped inside an end portion of anchoring member 10 which has a pin 36 extending therethrough. Pin 36 and pin 12 cooperate to secure C-shaped rail 11 to anchoring member 10. Preferably, a tubular bushing 37 is wedge-fitted into an end of anchoring member 10 to provide a smoother bearing surface for swivel action. Bushing 37 includes a flange 38 and a pair of diametrically opposed notches, one of which is shown at 39. Bushing 37 acts as one element of the locking means structure. The second element is a housing 40 which has a lug 41.

Preferably, the shoulder surfaces of notch 39, such as 42, are slightly tapered to mate with a similarly tapered shoulder on lug 41. This causes the two elements to engage firmly without longitudinal end play. It is desired that the taper of shoulder surfaces 42 be sufficiently small so as not to cause an automatic camming of the parts as might occur when a patient's body pushed outwardly against the rail. Because there is only a slight taper on shoulder surfaces 42, a deliberate grasping and longitudinal disengagement of the two elements is required by the nurse or physician before the rail can be moved.

Housing 40 is held from rotation relative to rail 11 by a pin 43 extending through rail 11. Protruding sections of pin 43 are adapted to longitudinally slide in slots 44 and 45 of housing 40. This permits the housing 40 to move from a position shown in FIG. 5 to that shown in FIG. 6 without rotating relative to rail 11.

Housing 40 is spring biased to the left in FIG. 5. This is done by a spring 46 which is in compression and engages a pin 47 which protrudes through both the housing 40 and rail 11. Pin 47 is firmly anchored to housing 40, but there is a longitudinal slotted opening 48 in rail 11 to allow for rearward movement of pin 47 from the position shown in FIG. 5 to that shown in FIG. 6. An opposite end of spring 46 abuts a pin 49 through rail 11.

With the above patient restraining system, it can be seen that a very narrow rail system can be used that takes only limited space to swivel outwardly from the bed. The posts provide a vertical adjustment in addition to the pivoting action.

In the foregoing description, a specific example has been used to describe the invention. However, it is understood by those skilled in the art that certain modifications can be made to this example without departing from the spirit and scope of the invention.

I claim:

1. A patient restraining rail system for joining to a bed or the like comprising: a rail support with an anchoring member having end portions; an outwardly pivoting generally C-shaped rail telescopically connected to the anchoring member's end portions at pivot joints with the anchoring member extending across a gap in the rail; means attached to the support for adjusting the location of the rail's pivot axis; and a spring biased lock with an element attached to each of the anchoring member and rail to hold the rail in a particular pivotal position relative to the anchoring member.

2. A rail system as set forth in claim 1, wherein both elements are secured against rotational movement to their respective anchoring member and rail; and at least one member is longitudinally slidable against such spring bias.

3. A rail system as set forth in claim 2, wherein the elements have an interfitting lug and notch structure that is disengaged upon the longitudinal movement of such element.

4. A rail system as set forth in claim 3, wherein the lug and notch have surfaces tapered for firm locking, but the taper is of an amount that is insufficient to cam the elements apart by relative rotational movement.

5. A rail system as set forth in claim 1, wherein the rail support includes at least one post connected to the anchoring member, and a base member for securement to a bed or the like, said post being adjustable relative to the base member.

6. A rail system as set forth in claim 5, wherein the base member includes a pair of tubular guides, and there are a pair of posts connected to the anchoring member, which posts are telescopically received within the guides.

7. A rail system as set forth in claim 6, wherein there is a latch means for securing the guides and posts together at a particular position.

8. A rail system as set forth in claim 7, wherein at least one guide has a retention opening, and its post has a series of spaced openings for matching up with the retention opening, and the latch means includes a prong for insertion through such matched openings.

9. A rail system as set forth in claim 8, wherein each guide and post has such openings, and there are two prongs pivotally connected to a handle, said prongs being spring biased in a direction toward such openings.

10. A bed or the like, wherein the improvement comprises: a patient restraining rail system joined to the bed, which system includes a rail support with an anchoring member having end portions; an outwardly pivoting generally C-shaped rail telescopically connected to the anchoring member's end portions at pivot joints with the anchoring member extending across a gap in the rail; means attached to the support for adjusting the location of the rail's pivot axis; and a spring biased lock with an element attached to each of the anchoring member and rail to hold the rail in a particular pivotal position relative to the anchoring member.

11. A bed or the like as set forth in claim 10, wherein the support includes a transverse anchoring member about which the rail can swivel, a base secured to the bed or the like, and a pair of posts which are secured to the transverse anchoring member and are vertically adjustable relative to the base.

12. A patient restraining rail system for joining to a bed or the like comprising: a rail support with an anchoring member having spaced apart pivot joints; an outwardly pivoting rail having spaced apart pivot joints interconnected with the anchoring member's pivot joints; a pair of laterally spaced posts fixedly securing to the anchoring member for controlling the lateral spacing between such posts, whereby the posts can readily be moved in post guiding structure of a bed or the like without binding; and a lock means located at a pivot joint of the rail and anchoring member.

13. A patient restraining rail system as set forth in claim 12, wherein there is a bed or the like with a pair of laterally spaced tubular guides which telescopically receive the posts.

14. A patient restraining rail as set forth in claim 12, wherein the anchoring member is tubular.

* * * * *